US006347797B1

(12) United States Patent
Tsai

(10) Patent No.: US 6,347,797 B1
(45) Date of Patent: Feb. 19, 2002

(54) GAME TABLE WITH USING MODES CONVERTIBLE BY WAY OF ROTATION

(76) Inventor: Lore Tsai, No. 22, Lane 20, Zichiang Street, East Area, Taichung City (TW)

( * ) Notice: Subject to any disclaimer, the term of this patent is extended or adjusted under 35 U.S.C. 154(b) by 0 days.

(21) Appl. No.: 09/531,153

(22) Filed: Mar. 17, 2000

(51) Int. Cl.[7] ..... A63F 7/36

(52) U.S. Cl. ..... 273/309; 473/6; 473/14; 473/16; 473/41

(58) Field of Search ..... 273/309; 473/1, 473/4, 6, 9, 10, 14, 16, 41

(56) References Cited

U.S. PATENT DOCUMENTS

| | | | | |
|---|---|---|---|---|
| 747,726 | A | * | 12/1903 | Karhan |
| 1,353,728 | A | * | 9/1920 | Dence |
| 3,227,105 | A | * | 1/1966 | Reisdorff |
| 4,305,581 | A | * | 12/1981 | Neuharth |
| 4,722,530 | A | * | 2/1988 | Hendon |
| 6,109,607 | A | * | 8/2000 | Cartwright |

FOREIGN PATENT DOCUMENTS

ZA 0238471 A2 * 1/1987

* cited by examiner

*Primary Examiner*—Benjamin H. Layno
*Assistant Examiner*—V K. Mendiratta
(74) *Attorney, Agent, or Firm*—Troxell Law Office PLLC

(57) ABSTRACT

Game table with using modes convertible by way of rotation, including: a table frame two ends of which are disposed with two end boards, at least one end board being formed with at least one through hole; a table body which is a frame body, a top and a bottom faces of the table body being respectively designed with two game modes, at least one end of the table body being formed with a through hole communicating with an interior of at least one game mode, two ends of the table body being respectively pivotally connected with the two end boards of the table frame, whereby the table body is rotatable on the table frame and after the table body is turned to its true position, the through hole of the end wall is aligned with the through hole of the end board; a locating mechanism disposed between the table frame and the table body for locating the table body at a certain position, the locating mechanism being able to disconnect the table body from the table frame, permitting the table body to be rotated; and at least one ball collecting box disposed on at least one end board and positioned at outer end of the through hole of the end board, whereby by means of turning and locating the table body, the game modes can be converted and the articles driven on the table body in the game can pass through the through holes to drop into the ball collecting box.

23 Claims, 11 Drawing Sheets

GAME TABLE WITH USING MODES CONVERTIBLE BY WAY OF ROTATION

BACKGROUND OF THE INVENTION

The present invention relates to a game table which can be operated by way of rotation to convert the game modes.

There are many types of game tables on which a game simulating a sport is played, such as the billiard table, the table for playing table football and the table for playing table hockey. The early game table can only provide one single type of game for the players. That is, the players can only play one single type of game on the game table. Some of the recently developed game tables are convertible for the players to play different kinds of games on the same table.

FIGS. 1A and 1B show a convertible game table 10 including a table body 12 and several table boards. In FIG. 1B, one table board 14 is exemplified. Two plane faces 16, 18 of the table board 14 are manufactured into two different game table faces such as billiard table or table hockey. When the table board 14 is placed on the table body 12 with the plane face 16 facing upward, a billiard table is formed. Reversely, when the other plane face 18 of the table board 14 is faced upward, a table of table hockey is formed. Accordingly, one table can be converted for playing two kinds of games.

Although the above game table is convertible for playing different kinds of games, there still are some shortcomings existing in such game table. For example, when converting the type of the game, a player must take out and place in the table board. Under such circumstance, the table board must be separated from the table body. It often takes place that during transferring the table board, a player is incautiously collided or pinched and injured by the table board or the table board drops down to hit and injure the feet of the player. Therefore, the conventional game table structure cannot be conveniently and safely used.

SUMMARY OF THE INVENTION

It is therefore a primary object of the present invention to provide a game table which by way of rotation is convertible between different using modes so that the safe is ensured when converting the using mode of the game table.

The present invention can be best understood through the following description and accompanying drawings wherein:

DETAILED DESCRIPTION OF THE PREFERRED EMBODIMENTS

Figure 1B:
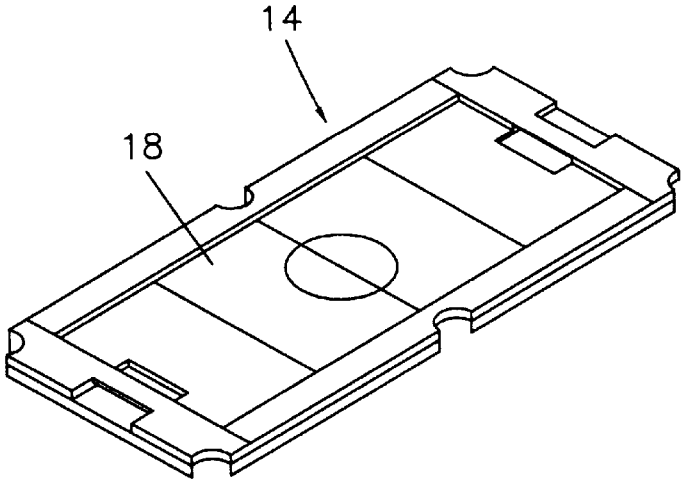
FIG. 1B PRIOR ART
FIG. 1B shows that the other face of the table board of FIG. 1A is faced upward to form another type of game table.
Figure 1A:
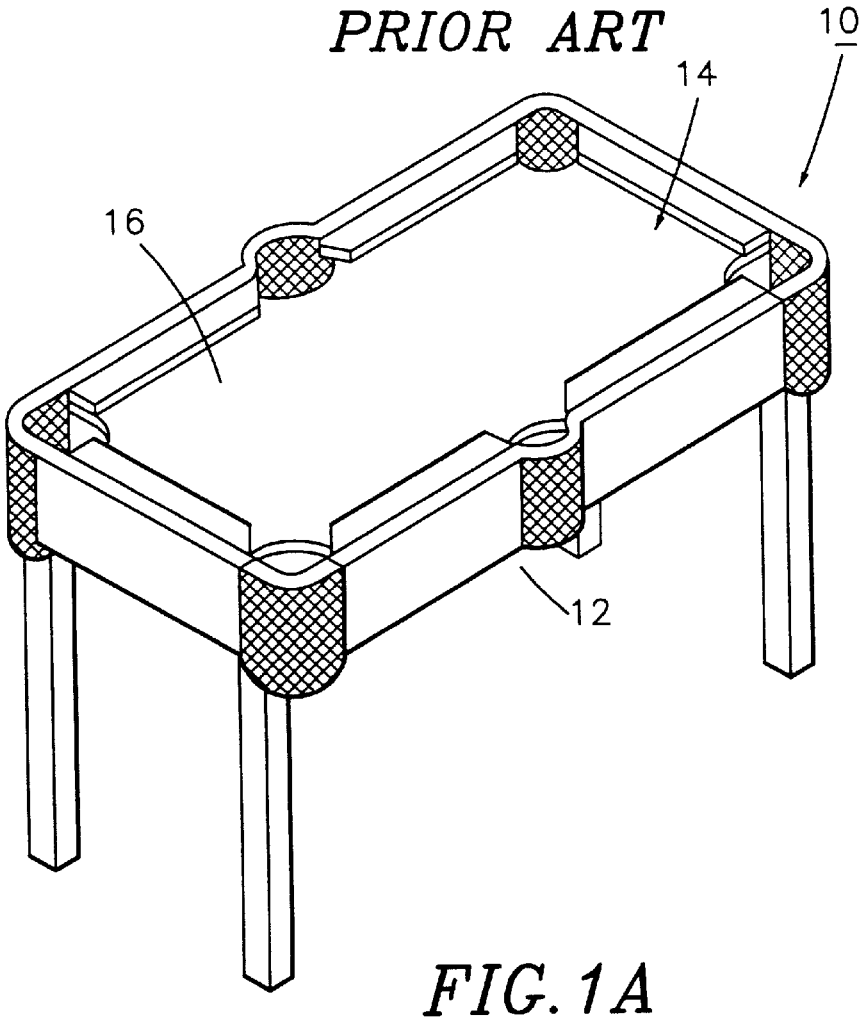
FIG. 1A PRIOR ART
FIG. 1A shows a conventional game table on which a table board is placed with one face facing upward to form a billiard table.
Figure 2:
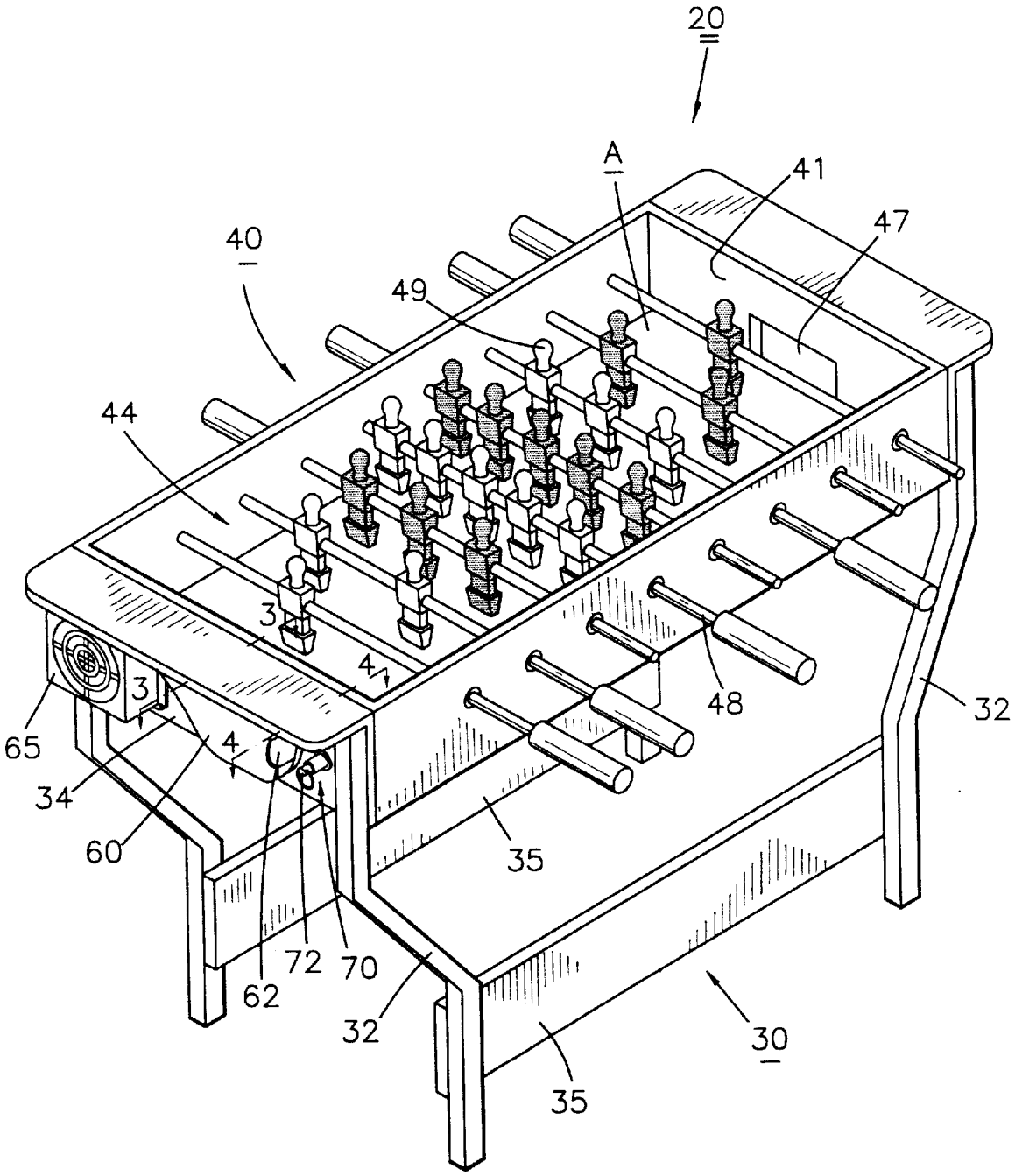
FIG. 2 is a perspective view showing one using mode of the game table of the present invention.
Figure 5:
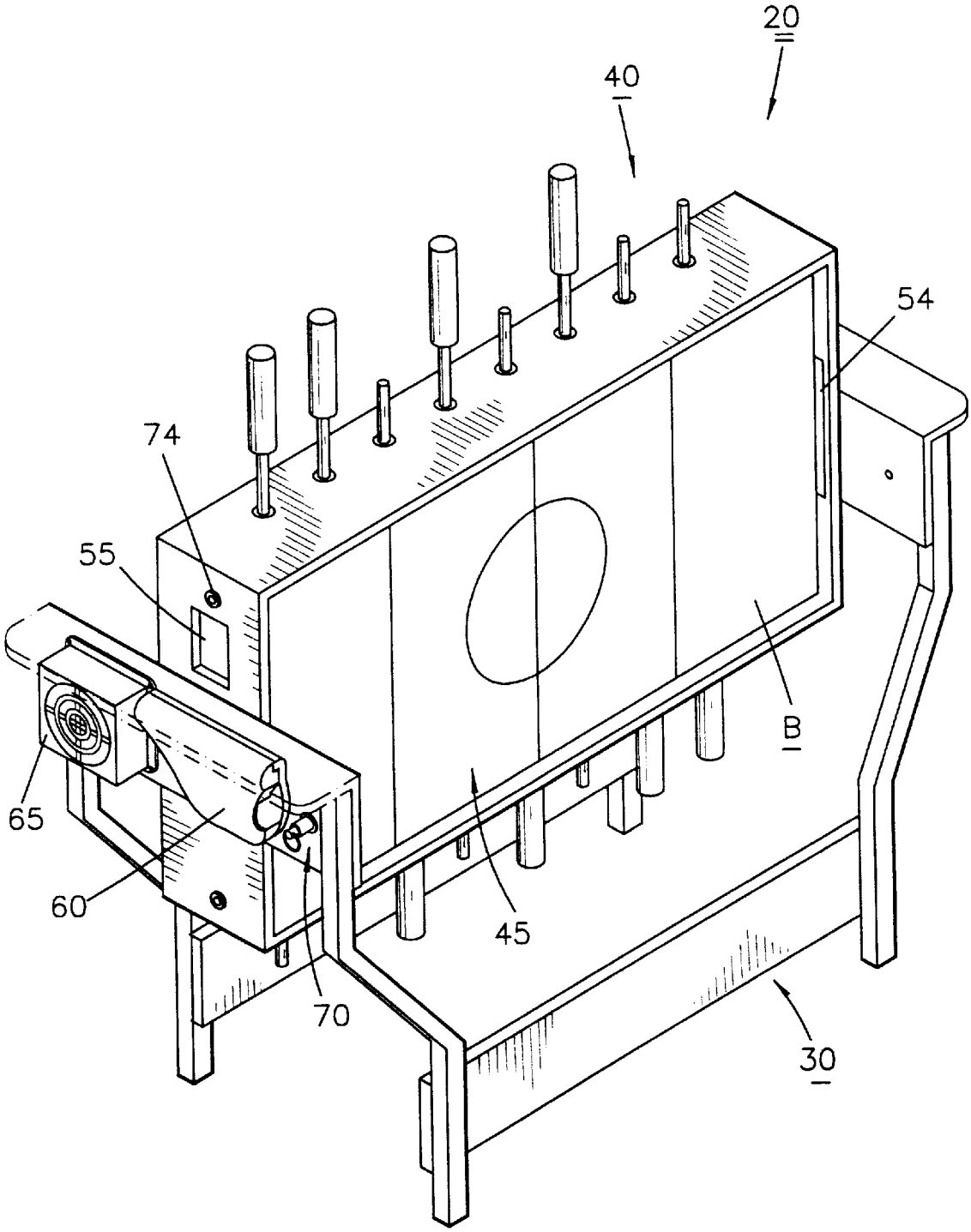
FIG. 5 shows that the game table of the present invention is converted from one using mode to another using mode.
Figure 6:
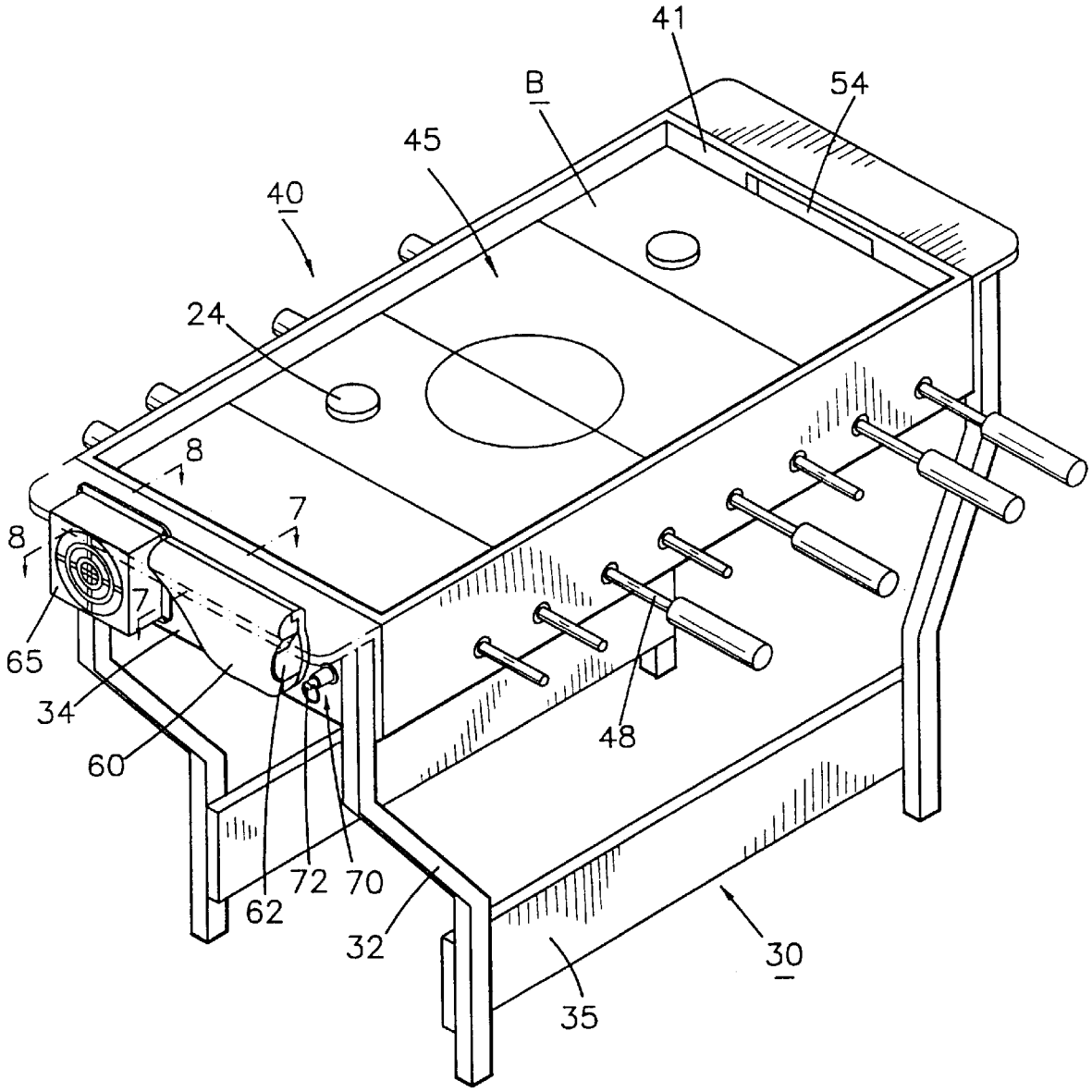
FIG. 6 is a view according to FIG. 5, showing the other using mode of the game table after converted.

Please first refer to FIGS. 2, 5 and 6. The game table 20 of the present invention includes a table frame 30 and a table body 40. The table body 40 is rotatably located on the table frame 30. The top and bottom faces of the table body are respectively designed with different game types which can be smoothly converted.

Figure 3:
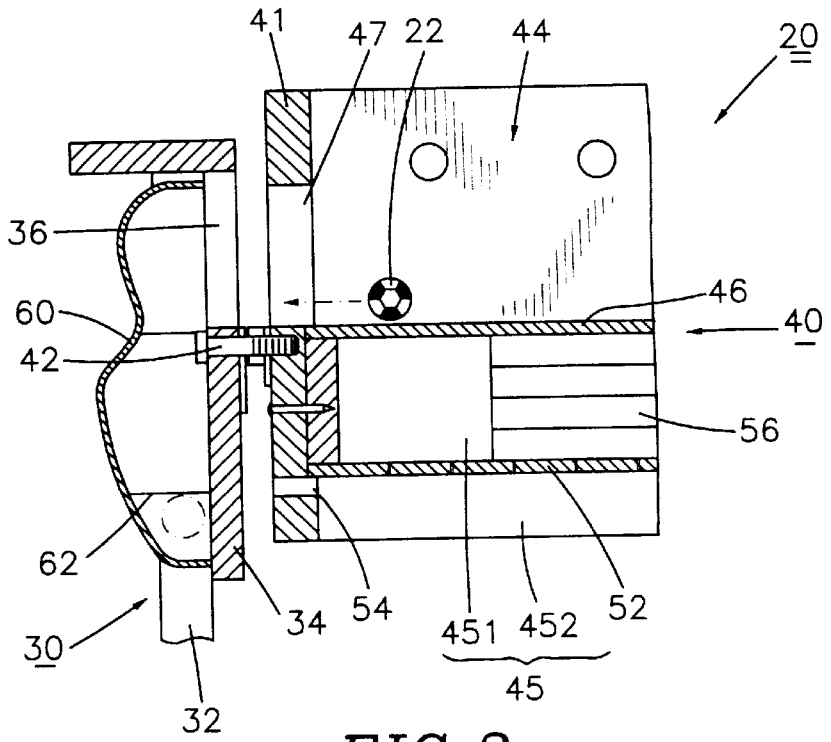
FIG. 3 is a sectional view taken along line 3—3 of FIG. 2.
Figure 7:
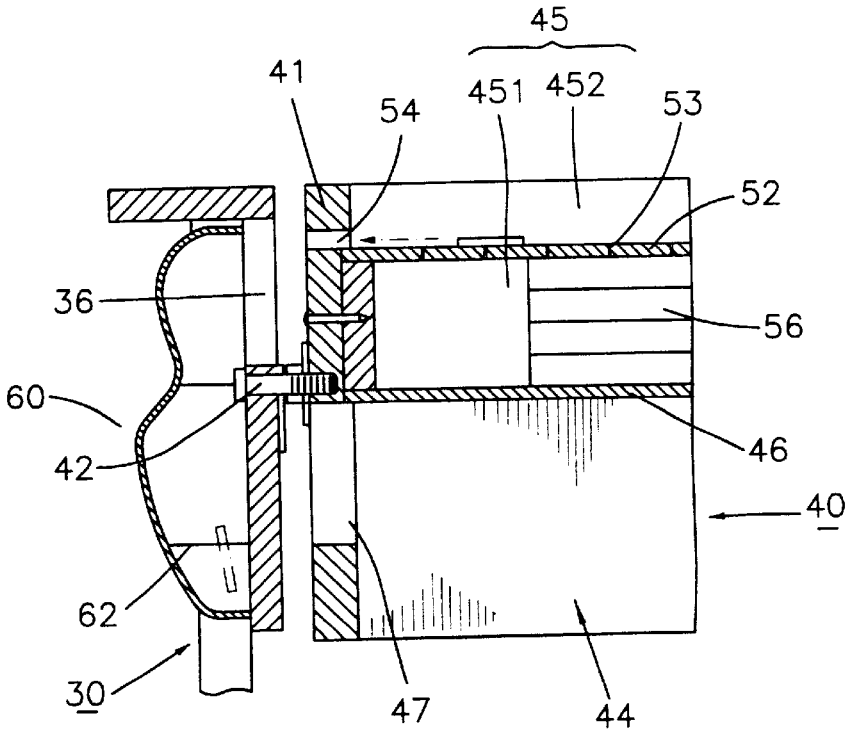
FIG. 7 is a sectional view taken along line 7—7 of FIG. 6.
Figure 8:
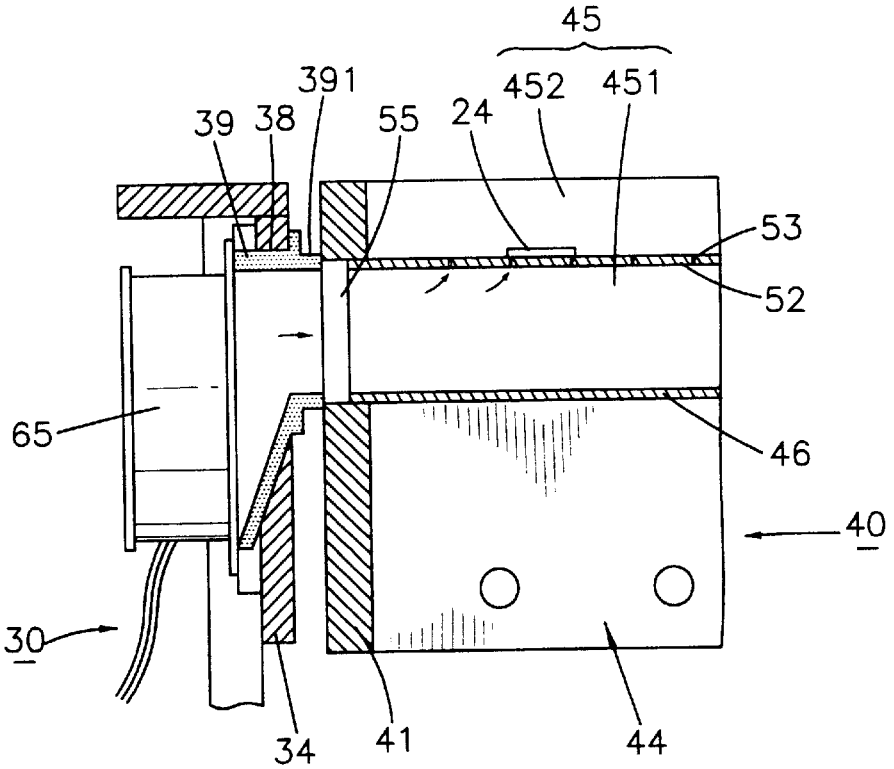
FIG. 8 is a sectional view taken along line 8—8 of FIG. 6.

FIGS. 1 to 8 show a first embodiment of the game table of the present invention, including:

a table frame 30 having two pairs of parallel table legs 32, the top ends of each pair of table legs 32 being connected by a transverse end board 34, the two pairs of table legs 32 being interconnected by two connecting slats 35; and a table body 40 which is a rectangular frame body having a certain thickness. The table body 40 is horizontally positioned. The top and bottom faces of the table body are respectively designed with two game modes A and B. As shown in FIG. 3, two ends of the table body 40 are respectively pivotally disposed at the transverse end boards 34 of the table frame 30 via two pivot shafts 42, whereby the table body 30 is rotatably located on the table frame 30. After the table body is turned by 180 degrees, a game can be converted into another. The top and bottom faces of the table body are respectively formed with two recess spaces 44, 45. Referring to FIG. 3, the two recess spaces 44, 45 are formed by means of partitioning the table body with a partitioning board 46 positioned at the middle of the thickness of the table body. The two spaces 44, 45 are such arranged to form two different types of sport games. The sport game of this embodiment is such that in the first space 44, a table football game A is arranged, while in the second space 45 is arranged a table hockey game B. The table frame and the table body are formed with several holes in cooperation with the sport game. In order to form the football game aspect, the centers of two end walls 41 of the first space 44 are respectively formed with two goalmouths 47. Several rotary rods 48 are passed through two lateral walls. A certain number of dolls 49 are fitted on each rotary rod 48. With respect to the second space 45 for forming the table hockey game pattern, as shown in FIG. 7, a second partitioning board 52 is disposed to further divide the second space into an inner and an outer spaces 451, 452. The second partitioning board serves as the table hockey face and is formed with multiple fine vents 53 communicating the inner and outer spaces 451, 452. In addition, the centers of two end walls 41 of the second space 45 are respectively formed with two slot-like wickets 54 at a height of the outer space 452 in communication with the outer space 452. A lateral side of one end wall is additionally formed with a ventilating opening 55 as shown in FIG. 8. The opening 55 is formed at a height of the inner space 451 in communication with the inner space. The two partitioning boards 46, 52 are interconnected by several longitudinal reinforcing rib boards 56.

The two end boards 34 of the table body 30 are formed with several holes corresponding to the goalmouths 47 and wickets 54 and the opening 55. The centers of the end boards 34 are respectively formed with two through holes 36 above the pivot shafts 42 as shown in FIGS. 3 and 7. A lateral side of one of the end boards 34 is additionally formed with a through hole 38 corresponding to the opening 55 as shown in FIG. 8. A wind guiding member 39 is fixed in the through hole 38. The wind guiding member 39 is a rectangular tube made of plastic or rubber material. A lip section 391 of the wind guiding member 39 outward extends to contact with the end of the table body 40 and cover the periphery of the opening 55.

Two ball collecting boxes 60 are respectively fixed at outer ends of the two end boards 34 to cover the through holes 36. The ball collecting box 60 is a container with an opening. Two sides thereof are notched to form a taking section 62.

A blower 65 is fixed at outer end of the end board 34 at the through hole 38 as shown in FIGS. 2 and 8.

Figure 4:
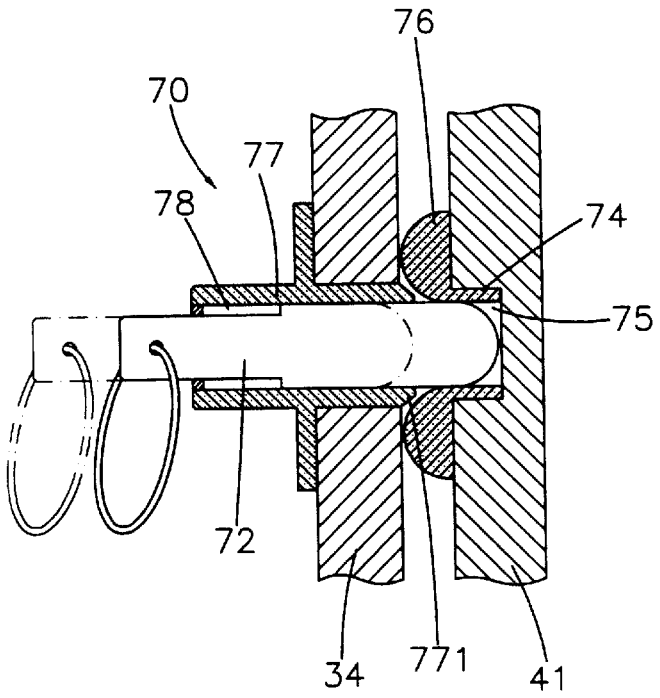
FIG. 4 is a sectional view taken along line 4—4 of FIG. 2, showing the locating structure of the table frame and the table body of the present invention.

The present invention further includes a locating mechanism. In this embodiment, the locating mechanism has four locating members 70 respectively disposed on four corners of the game table. As shown in FIG. 4, each locating member 70 is inserted on the end board 34 and the end wall 41 of the table body via an insertion pin-like fixing member 72. The locating member 70 has a socket 74 and a shaft seat 77. The socket 74 has an insertion hole 75. One end of the locating member is formed with an outward projecting annular section 76. The body of the socket 74 is embedded in one side of the end wall 41 of the table body with the annular section 76 protruding from the outer end of the end wall 41. The shaft seat 77 is formed with an axial shaft hole 78. The body of the shaft seat is embedded in the end board 34 corresponding to a socket 74. The inner end 771 of the shaft seat 77 slightly protrudes from the inner end of the end board. The fixing member 72 is reciprocally slidably passed through the shaft hole 78 of the shaft seat 77 to engage with the shaft seat so that the sliding travel of the shaft seat has a stopping point. The fixing member 72 is inserted in the shaft hole 78.

In use, when a player desires to play the table football, as shown in FIG. 2, the table body 40 is turned and located with the first space 44 of football game arrangement A facing upward. Then the fixing members 72 are inserted into the shaft holes 78 of the shaft seats 77 to connect and locate the table body 40 on the table frame 30 as shown by solid line of FIG. 4. At this time, the goalmouth 47 is aligned with the through hole 36 of the table frame as shown in FIG. 3. The player can control the dolls 49 and drives the game ball 22 into the goalmouth 47 to get a goal. After the game ball 22 enters the goalmouth 47, the ball passes through the through hole 36 and drops into the ball collecting box 60. At this time, the player can take out the ball through the taking section 62 of the ball collecting box for further playing the game.

When it is desired to convert the game into the table hockey, the player first draws the fixing members 72 out of the insertion holes 75 as shown by phantom line of FIG. 4 so as to disconnect the table body 40 from the table frame 30. Then the player turns the table body by 180 degrees as shown in FIG. 5 so as to convert the table body into a aspect with the second space 45 of table hockey pattern B facing upward as shown by FIG. 6. During turning operation of the table body, it can be known from FIG. 4 that when the table body is about to turn to the true position, the inner end 771 of the shaft seat 77 will pass over the annular section 76 of the socket 74 to slightly resiliently outward expand the end board 34 and suffer a certain resistance. After the inner end 771 is aligned with the shaft hole 75, the resistance will disappear and the end board 34 will bound back. Accordingly, when the table body is turned on its true position, a locating effect is automatically achieved and the player will feel that the shaft seat 77 is truly aligned with the socket 74. Thereafter, the player can inward push the fixing member 72 and again insert the fixing member 72 into the shaft hole 75 to complete the connection between the table body and the table frame.

After the table body is turned and located, the wicket 54 is aligned with the through hole 36 as shown in FIG. 7 and the opening 55 is aligned with the through hole 3 8 as shown in FIG. 8. At this time, the lip section 391 of the wind guiding member 39 covers the periphery of the opening.

The table hockey game is played in the outer space 452. The player can hold a driving member (not shown) to drive the circular plate 24 into the wicket 54 and score. After the circular plate 24 enters the wicket 54, it will pass through the through hole 36 and drop into the ball collecting box 60. At this time, the player can also take out the circular plate through the taking section 62 for further playing the game.

When playing the table hockey game, the blower 65 is turned on to make air flow through the through hole 38 from the opening 55 into the inner space 451 under guiding of the wind guiding member 39 and further upward blow from the vents 53 toward the outer space 452. Accordingly, the frictional force between the circular plate 24 and the second partitioning board 52 is reduced and the slidability of the circular plate is enhanced.

Figure 11:
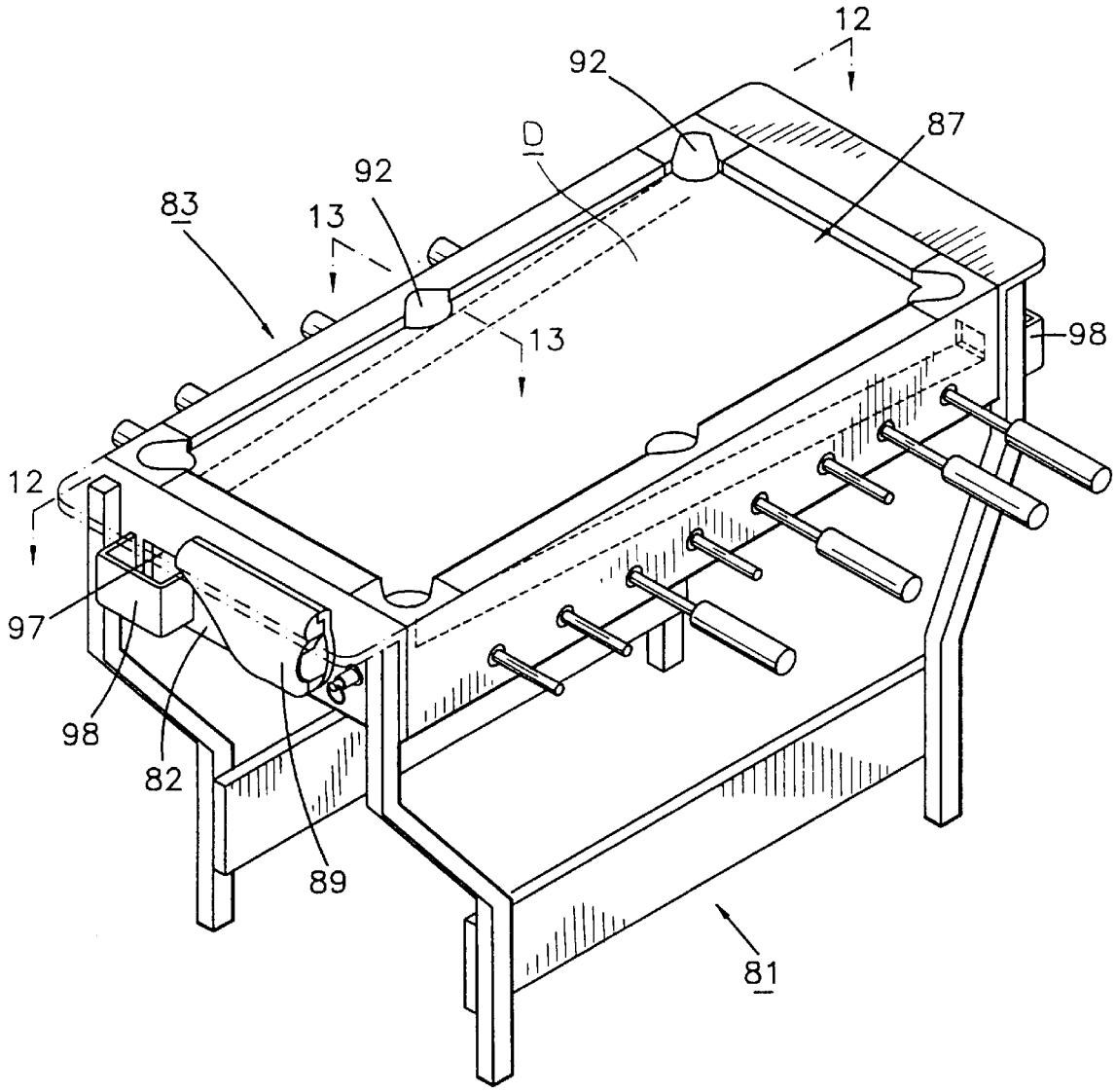
FIG. 11 is a view according to FIG. 10, showing the other using mode of the game table of FIG. 10 after converted.

FIGS. 9 to 13 show a second embodiment of the present invention, in which the game table also provides two sport games, that is, football C and billiards D which are arranged respectively on the top and bottom faces of the table body 83. The connecting and locating structures of the table frame 81 and table body 83 of this embodiment are identical to those of the above embodiment, whereby by means of the operation of FIG. 10, the football game can be converted into billiards as shown in FIG. 11.

Figure 9:
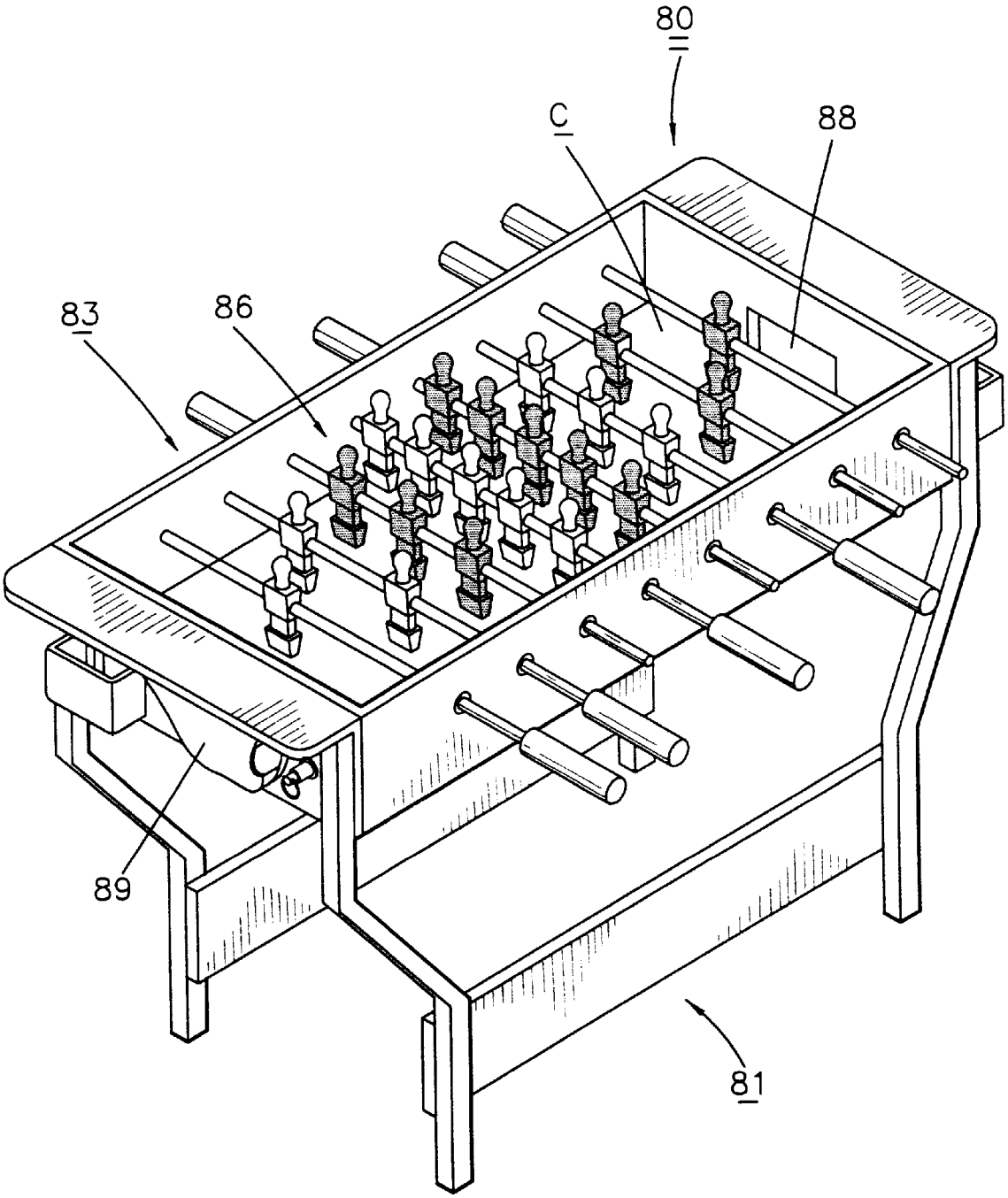
FIG. 9 is a perspective view of another embodiment of the present invention, showing one using mode.
Figure 10:
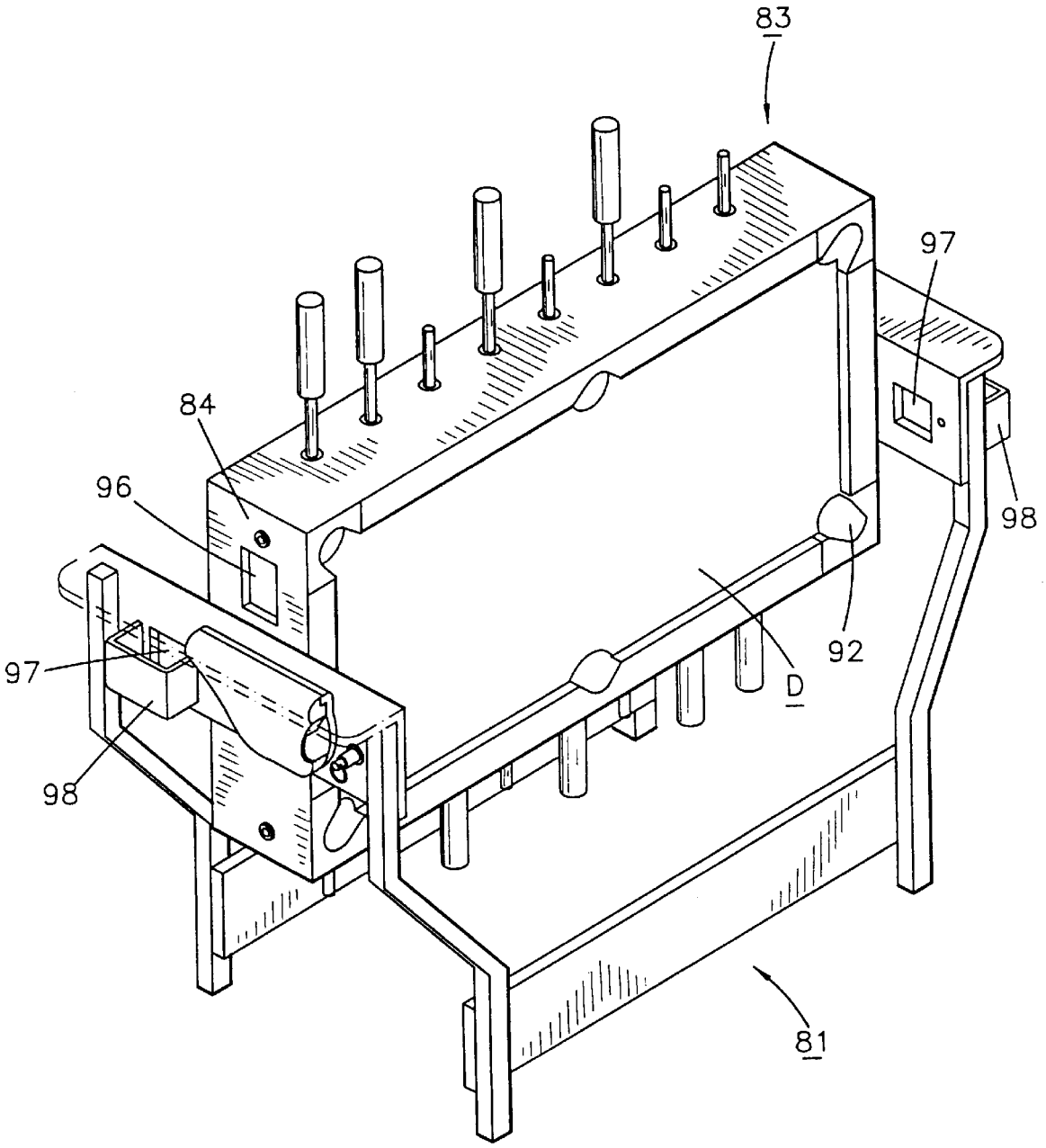
FIG. 10 shows that the game table of FIG. 9 is converted from one using mode to another using mode.

In this embodiment, the table body 83 is also divided into a first and a second spaces 86, 87 by a partitioning board 85. The two spaces 86, 87 are respectively arranged with the table football game and billiards C and D. With respect to the football game, as shown in FIG. 9, the ball can enter the goalmouth 88 and drop into the ball collecting box 89. This structure is identical to the above one and will not be further described.

Figure 12:
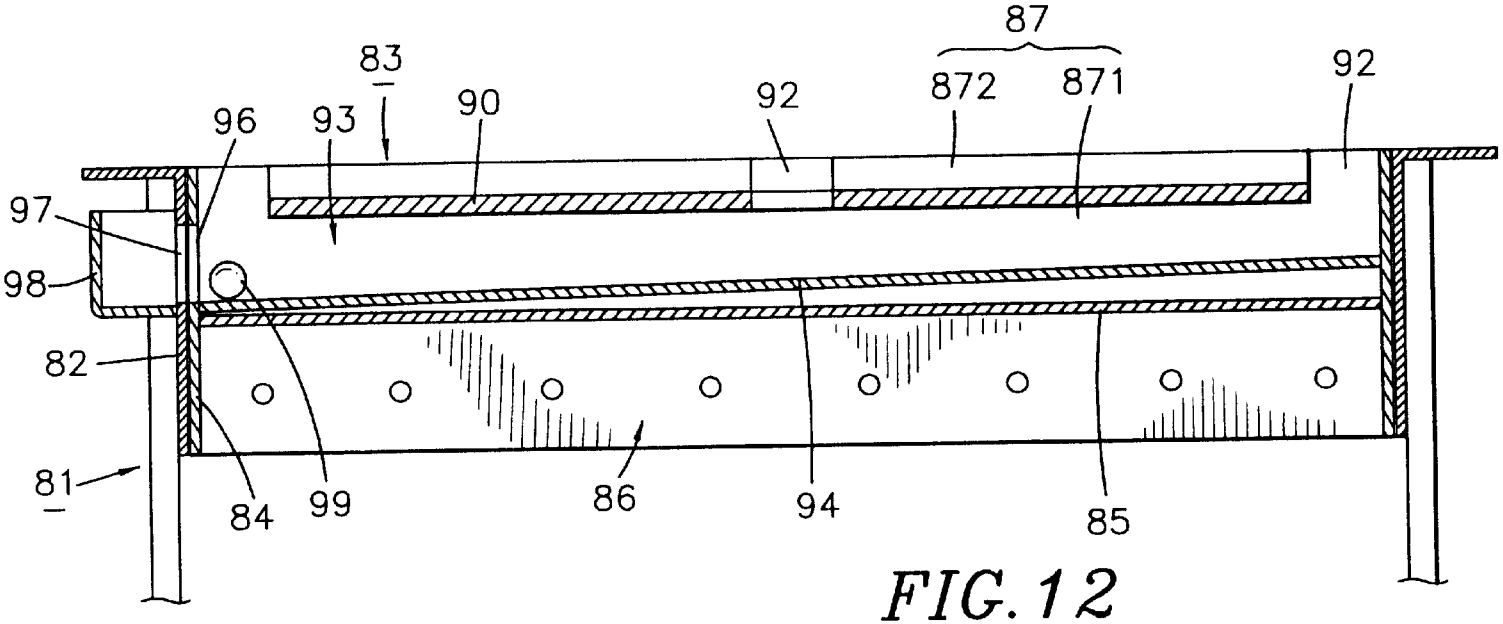
FIG. 12 is a sectional view taken along line 12—12 of FIG. 11.
Figure 13:
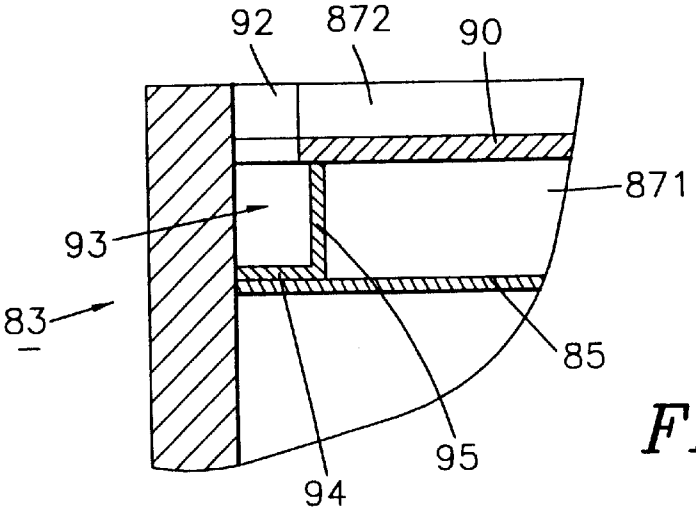
FIG. 13 is a sectional view taken along line 13—13 of FIG. 11.

With respect to the billiards D, the second space 87 of the ball body is also partitioned by a second partitioning board 90 into an inner and an outer spaces 871, 872 as shown in FIG. 12. The second partitioning board 90 serves as the billiard table face. Each of the four corners and the middle sections of the long sides of the second partitioning board is formed with a through hole 92. In the inner space 871, an inclined ball way 93 is correspondingly disposed under each of the three holes 92 of each of the long sides. In practice, as shown in FIG. 13, the ball way is formed by an inclined board 94 and an upright board 95. In addition, each end wall of the table body 83 is formed with an opening 96 corresponding to the lower end of the ball way.

The lateral side of each of the end boards 82 of the table frame 81 is also formed with a through hole 97 corresponding to the opening 96. Two second ball collecting boxes 98 are respectively disposed at outer ends of the end boards 82 at the exits of the through holes 97.

When playing the billiards D, as shown in FIG. 12, after the ball 99 is hit into the hole 92, the ball will drop onto the ball way 93 and roll to the lower end thereof. Then the ball goes through the opening 96 and through hole 97 to drop into the ball collecting box 98. A player can take out the ball through the opening of the ball collecting box 98 for further playing the game.

The above two ball ways 93 are reversely inclined so that the balls dropping into the two ball ways are respectively collected by two ball collecting boxes 98 disposed on the two end boards 82. In practice, there are otherwise alternatives. For example, the two ball ways can be inclined in the same direction and the two ball collecting boxes are disposed on the same end board. Alternatively, one single ball way can be disposed in the inner space 871 and the balls dropping into the six holes 92 can be guided to the same opening 96. Accordingly, it is necessary to dispose only one ball collecting box at one of the end boards to collect all the balls.

Figure 14:
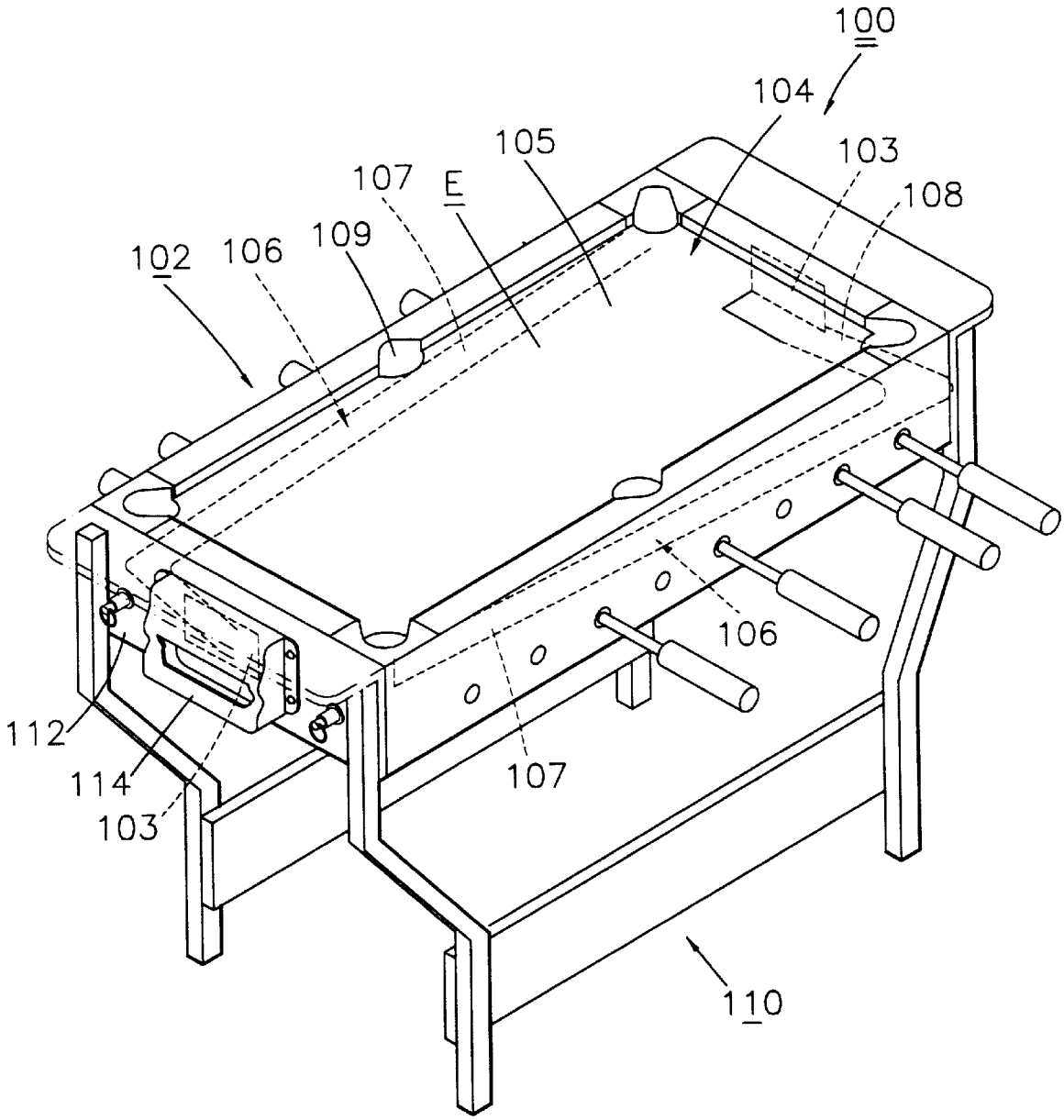
FIG. 14 is a perspective view of still another embodiment of the present invention.

FIG. 14 shows a third embodiment of the present invention, in which the top and bottom faces of the table body 102 of the game table 100 are arranged with billiard game E and football game. In this embodiment, the second space 104 of the table body 102 is also divided into an inner space and an outer space 105 by a partitioning board. The outer space forms the billiard game face. Two ball ways 106 are disposed in the inner space. Each ball way 106 has a longitudinal section 107 and a transverse section 108. The longitudinal section 107 corresponds to the three holes 109 on each long side. The two transverse sections 108 extend to two ends of the table body 102 and respectively correspond to the through holes 103 formed at the centers of the two ends of the table body.

In use, the ball dropping into the hole 109 is guided by the ball way 106 to roll to the through hole 103. Then the ball goes through the opening (not shown) of the end board 112 of the table frame 110 to drop into the ball collecting box 114 disposed at two ends of the end board 112. A player can take out the ball from the ball collecting box for further playing the game.

The above embodiments are only used to illustrate the present invention, not intended to limit the scope thereof. Many modifications of the above embodiments can be made without departing from the spirit of the present invention. For example, the table body can be arranged with combination of hockey game and billiards or combination of bowling and shuffleboard, etc.

According to the above arrangement, when converting the game mode, it is unnecessary to separate the table body from the table frame and the game can be conveniently converted only by means of rotating the table body and locating the table body. Therefore, the shortcomings existing in the prior art are eliminated that a player is incautiously collided or pinched and injured by the table body or the table body drops down to hit and injure the feet of the player. Therefore, the safety in use of the game table is ensured.

What is claimed is:

1. A convertible game table for playing a plurality of different games, each game including at least one movable playing object, the table comprising:

a) a stationary table frame including a plurality of table legs and two, opposite, stationary end boards located at opposite ends of the table frame, at least one of the end boards having a first through hole configured to allow the at least one movable playing object to pass therethrough;

b) a game table body having two opposite end walls pivotally attached to the end boards of the table frame, the table body further having first and second faces configured to play first and second different games thereon, the first and second faces separated by a partitioning board, at least one end board having at least one second through hole on each side of the partitioning board;

c) a locating mechanism between at least one end board and at least one end wall to releasably lock the table body in a first playing position such that a game may be played on the first surface and in a second playing position such that a game may be played on the second surface, whereby, in each first and second playing positions, the second through hole is aligned with the first through hole so as to allow passage of the movable playing object from the surface through the second and first through holes; and, d) a collecting box mounted on the at least one end board having the first through hole, the collecting box located adjacent to the first through hole such that the movable playing object is collected and stored in the collecting box after passing through the first through hole.

2. The convertible game table as claimed in claim 1, wherein at least one of the first and second faces of the table body is formed with a recess space for playing a game, the second through hole of the end wall communicating with the recess space.

3. The convertible game table as claimed in claim 2, wherein: the second through holes are formed in the two end walls of the table body; the first through holes are formed in the two opposite end boards; and two collecting boxes are disposed on the two opposite end boards adjacent the first through holes.

4. The convertible game table as claimed in claim 2, wherein the recess space is further divided into inner and outer recess spaces by a second partitioning board, such that the second through holes communicate with the outer recess space.

5. The convertible game table as claimed in claim 2, wherein the recess space is further divided into inner and outer recess spaces by a second partitioning board formed with a plurality of holes communicating with the inner and outer recess spaces, the second through holes communicating with the inner recess space.

6. The convertible game table as claimed in claim 1, wherein the first and second faces of the table body are respectively formed with first and second recess spaces for playing the first and second games, the second through holes communicating with one of the first and second spaces.

7. The convertible game table as claimed in claim 6, wherein: the second through holes are formed in the two end walls of the table body and communicate with one of the first and second recess spaces; the first through holes are formed in the two opposite end boards respectively; and two collecting boxes are disposed on the two opposite end boards adjacent the first through holes.

8. The convertible game table as claimed in claim 7, wherein the second through holes communicate with the first recess space.

9. The convertible game table as claimed in claim 6, wherein the first recess space is further divided into inner and outer recess spaces by a second partitioning board, such that the second through holes communicate with the outer recess space.

10. The convertible game table as claimed in claim 9, wherein: the second through holes include at least one through hole communicating with the outer recess space and at least one opening communicating with the inner recess space; the partitioning board has a plurality of vents communicating with the inner and outer recess spaces; the first through holes further including a hole aligned with the opening; and a blower for blowing air into the first through holes and the opening into the inner recess space, the air passing through the vents into the outer recess space.

11. The convertible game table as claimed in claim 10, further comprising a tubular air guiding member made of soft material, the air guiding member being fixed in the first through hole, and having a lip section protruding from an inner side of the end board in contact with the table body, whereby when the opening is aligned with the first through hole, the lip section covers a periphery of the opening.

12. The convertible game table as claimed in claim 6, wherein the first recess space is further divided into inner and outer recess spaces by a second transverse partitioning board formed with a plurality of holes communicating with the inner and outer recess spaces, the second through holes communicating with the inner recess space.

13. The convertible game table as claimed in claim 12, wherein the plurality of holes are linearly arranged and the game table further comprises at least one inclined ball way disposed in the inner space, the ball way being under the holes, a lower end of the ball way communicating with the second through holes.

14. The convertible game table as claimed in claim 13, wherein the plurality of holes are linearly arranged on opposite long sides of the table body, and the at least one inclined ball way comprises two linear ball ways respectively disposed under the holes of each opposite long side, a lower end of each ball way communicating with one second through hole.

15. The convertible game table as claimed in claim 14, wherein each inclined ball way is formed by an inclined board and a plurality of upright boards connecting with the inclined board.

16. The convertible game table as claimed in claim 6, wherein an interior of the table body is divided into first and second spaces by the partitioning board, the second space being further divided into inner and outer spaces by a second partitioning board, the second through holes of the end walls comprising at least one first and at least one second entrances, the first entrance communicating with the first space, the second entrance communicating with the outer space of the second space, the second through holes positioned above the pivot section of the table frame and table body, whereby when the table body is located with the first space facing upward, the first entrance is aligned with the first through hole, and when the table body is located with the second space facing upward, the second entrance is aligned with the first through hole.

17. The convertible game table as claimed in claim 16, further comprising a plurality of holes formed in the second partitioning board communicating with the inner and outer spaces.

18. The convertible game table as claimed in claim 1, wherein the locating mechanism includes a fixing member detachably connecting the table frame and table body.

19. The convertible game table as claimed in claim 18, wherein the fixing member comprises an insertion pin inserted into the table frame and table body.

20. The convertible game table as claimed in claim 19, wherein the locating mechanism further includes: a socket with an insertion hole disposed in the end wall of the table body; and a shaft seat with an axial shaft hole disposed in one of the end boards; the fixing member slidably passing through the shaft hole, one end of the fixing member being inserted into the insertion hole to connect the table body with the table frame and locate the table body.

21. The convertible game table as claimed in claim 20, wherein an end of the socket has an annular section protruding from an outer side of the end wall, an inner end of the shaft seat protruding from an inner side of the end board, whereby when the table body is pivoted on the table frame, the inner end of the shaft seat passes over the annular section and is located therein.

22. The convertible game table as claimed in claim 1, wherein the collecting box comprises a container having an opening, sides of the collecting box being notched to form a taking section, wherein the opening of the collecting box covering a periphery of the first through hole.

23. The convertible game table as claimed in claim 1, wherein the collecting box comprises a container having an opening on a top, the opening being positioned at a bottom edge of the first through hole.

* * * * *